US009757298B2

(12) United States Patent
Jones

(10) Patent No.: US 9,757,298 B2
(45) Date of Patent: Sep. 12, 2017

(54) SELF-CLOSING DOOR APPARATUS

(71) Applicant: General Electric Company, Schenectady, NY (US)

(72) Inventor: Thomas Jones, Columbia, MD (US)

(73) Assignee: General Electric Company, Schenectady, NY (US)

( * ) Notice: Subject to any disclaimer, the term of this patent is extended or adjusted under 35 U.S.C. 154(b) by 278 days.

(21) Appl. No.: 14/068,161

(22) Filed: Oct. 31, 2013

(65) Prior Publication Data

US 2015/0119634 A1 Apr. 30, 2015

(51) Int. Cl.
*A61G 11/00* (2006.01)

(52) U.S. Cl.
CPC ..... *A61G 11/009* (2013.01); *A61G 11/00* (2013.01); *A61G 11/005* (2013.01); *A61G 11/006* (2013.01)

(58) Field of Classification Search
CPC .... A61G 11/00; A61G 11/005; A61G 11/006; E05F 1/105; E05F 5/02; E05F 5/022; E05F 1/1276
See application file for complete search history.

(56) References Cited

U.S. PATENT DOCUMENTS

| | | | | |
|---|---|---|---|---|
| 4,191,174 | A * | 3/1980 | Martin | 600/22 |
| 5,129,879 | A * | 7/1992 | Mattson | 600/22 |
| 6,397,836 | B1 * | 6/2002 | Pelletier et al. | 126/194 |
| 8,474,103 | B2 * | 7/2013 | Lee | E05D 15/582 126/194 |
| 2002/0019578 | A1 * | 2/2002 | Honma et al. | 600/22 |
| 2003/0051409 | A1 * | 3/2003 | Bruns | 49/322 |
| 2005/0070756 | A1 * | 3/2005 | Falk | A61G 11/00 600/22 |

* cited by examiner

*Primary Examiner* — Catherine B Kuhlman
*Assistant Examiner* — Shannon McBride
(74) *Attorney, Agent, or Firm* — Andrus Intellectual Property Law, LLP

(57) ABSTRACT

A door retention system for an infant care device includes a plurality of links pivotably coupling a door with an infant care device, and an energy storage device secured to at least one of the links. The energy storage device is configured to apply a force tending to open the door exclusively when the door is in close proximity to a fully-open position. The energy storage device is also configured to apply a force tending to close the door exclusively when the door is in close proximity to a fully-closed position.

18 Claims, 4 Drawing Sheets

SELF-CLOSING DOOR APPARATUS

BACKGROUND OF THE INVENTION

The subject matter disclosed herein relates to a self-closing door apparatus that may, for example, be used with an infant care device such as an infant incubator or hybrid incubator/warmer.

Conventional infant incubators and hybrid incubator/warmers provide a confined enclosure adapted to retain an infant in a controlled environment. A convective heating system generates heated air to regulate temperature within the enclosure. Incubators and hybrid incubator/warmers may also comprise a humidifier configured to regulate the humidity within the controlled environment. Incubator doors or porthole doors may be implemented to provide access to the infant while only minimally disturbing the conditions within the controlled environment.

One problem with conventional infant incubators and hybrid incubator/warmers is their incubator doors may incompletely latch as they are being closed such that they unknowingly remain partially open and thereby jeopardize conditions in the controlled environment.

BRIEF DESCRIPTION OF THE INVENTION

The above-mentioned shortcomings, disadvantages and problems are addressed herein which will be understood by reading and understanding the following specification.

In an embodiment, a door retention system for an infant care device includes a plurality of links pivotably coupling a door with an infant care device, and an energy storage device secured to at least one of the links. The energy storage device is configured to apply a force tending to open the door exclusively when the door is in close proximity to a fully-open position. The energy storage device is also configured to apply a force tending to close the door exclusively when the door is in close proximity to a fully-closed position.

In another embodiment, an incubator door retention system includes a first link pivotably secured to an incubator, a second link pivotably secured between the first link and an incubator door, and an energy storage device secured between the incubator and the first link. The energy storage device is configured to apply a force tending to open the incubator door exclusively when the incubator door is in close proximity to a fully-open position. The energy storage device is also configured to apply a force tending to close the incubator door exclusively when the incubator door is in close proximity to a fully-closed position.

Various other features, objects, and advantages of the invention will be made apparent to those skilled in the art from the accompanying drawings and detailed description thereof.

DETAILED DESCRIPTION OF THE INVENTION

In the following detailed description, reference is made to the accompanying drawings that form a part hereof, and in which is shown by way of illustration specific embodiments that may be practiced. These embodiments are described in sufficient detail to enable those skilled in the art to practice the embodiments, and it is to be understood that other embodiments may be utilized and that logical, mechanical, electrical and other changes may be made without departing from the scope of the embodiments. The following detailed description is, therefore, not to be taken as limiting the scope of the invention.

Figure 1:
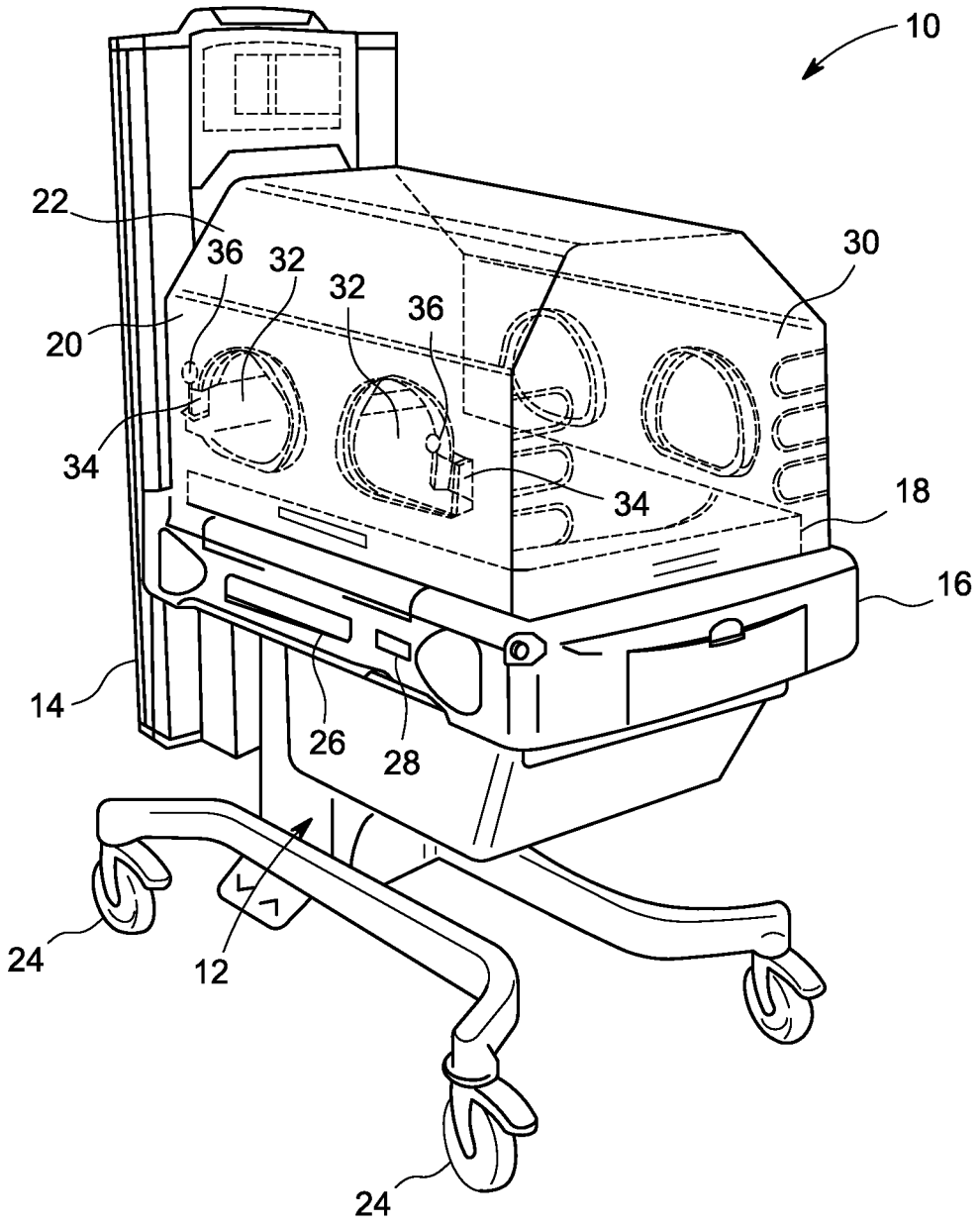
FIG. 1 is a sectional view of an incubator in accordance with an embodiment.

Referring to FIG. 1, an isometric view of an incubator 10 is shown in accordance with an embodiment. It should be appreciated that the infant incubator 10 is shown for illustrative purposes and that the present invention may be implemented with other infant care devices such as, for example, a hybrid incubator/warmer (not shown).

The incubator 10 may comprise an incubator base 12, a vertical frame 14, an incubator platform 16, an incubator mattress 18, a plurality of incubator walls 20 and an incubator hood 22. The incubator base 12 may include one or more wheels 24 to facilitate translation of the incubator 10. The vertical frame 14 may be secured to and extend vertically away from the incubator base 12. The incubator platform 16 may be secured to the vertical frame 14, or may alternatively be secured to the incubator base 12. The incubator mattress 18 may be secured to and supported by the incubator platform 16.

The incubator platform 16 may comprise a heating system 26, and a humidifier 28. According to one embodiment the heating system 26 is a convective heating system, however other heating systems may be envisioned. The incubator walls 20 and the incubator hood 22 define a confined enclosure 30 adapted to retain an infant patient (not shown). The heating system 26 regulates temperature within the enclosure 30, and the humidifier 28 regulates the humidity within the enclosure 30. An oxygen supply (not shown) may optionally be provided to regulate oxygen concentration within the enclosure 30.

One of the incubator walls 20 may define a plurality of incubator doors 32. For illustrative purposes the incubator door 32 will hereinafter be depicted as porthole doors. It should, however, be appreciated that the present invention may be implemented with other types of doors such as, for example, rectangular doors. The incubator doors 32 are adapted to provide access to an infant while only minimally disturbing the controlled conditions within the enclosure 30. As described in more detail below, each of the incubator doors 32 includes a retention system 34. The retention system 34 is adapted to facilitate the process of opening and closing the doors, to reduce the likelihood of an incomplete or partial door closure, and to allow for quiet door closure to thereby minimize patient disturbance.

The retention system 34 includes a handle or knob 36 which is engaged by a user and rotated to open one of the incubator doors 32. A user may directly engage an opened incubator door 32 and move it to the closed position. As will be described in more detail below, when an incubator door 32 is being closed and is in close proximity to its closed position, the retention system 34 acts to automatically move the incubator door 32 the rest of the way into its fully-closed position. It should be appreciated that this automatic closure eliminates the potential for an unintentional incomplete door closure.

Figure 2:
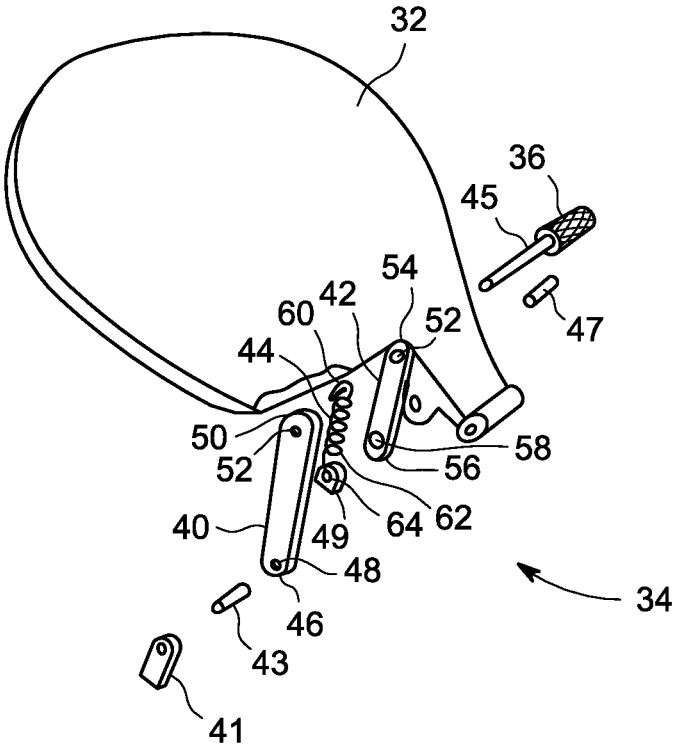
FIG. 2 is an exploded view of a retention system in accordance with an embodiment.

Referring to FIG. 2, an exploded view of illustrates the components of the retention system 34 in shown accordance with an embodiment. The retention system 34 includes an outer link 40, an inner link 42, the handle 36 and a spring 44. The spring 44 is described for illustrative purposes but may be replaced with alternate energy storage medium such as an elastomeric band.

A first terminal end 46 of the outer link 40 is rotatably secured to an incubator wall pivot post 41 at a first pivot point 48. A pivot pin 43 may be disposed through the first pivot point 48. An opposite terminal end 50 of the outer link 40 is rotatably secured to the inner link 42 at a second pivot point 52. The second pivot point 52 is defined at a first terminal end 54 of the inner link 42. A pivot pin 45 may be disposed through the second pivot point 52. An opposite terminal end 56 of the inner link 42 is rotatably secured to the incubator door 32 at a third pivot point 58. A pivot pin 47 may be disposed through the third pivot point 58.

The handle 36 may be secured to the pivot pin 45. A first terminal end 60 of the spring 44 may also be secured to the pivot pin 45. An opposite terminal end 62 of the spring 44 may be secured to an incubator wall pivot post 49 at the spring anchor point 64.

Figure 3:
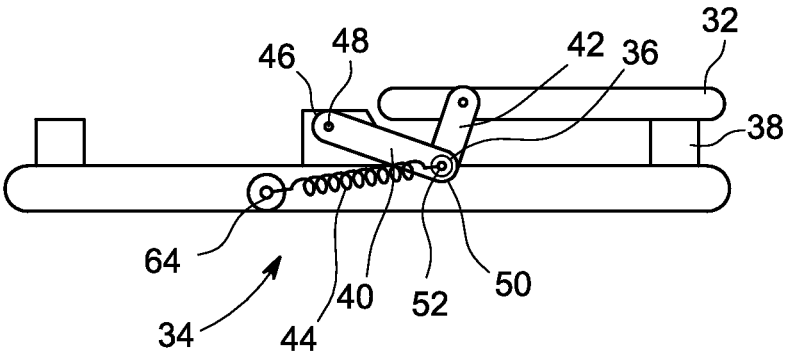
FIG. 3 is a sectional view of a retention system secured to an incubator door in a fully-open position in accordance with an embodiment.
Figure 4:
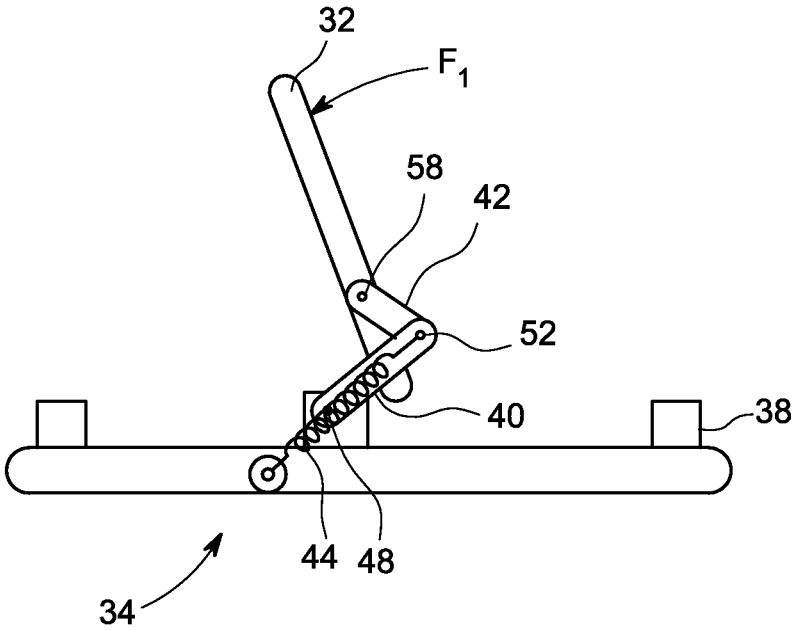
FIG. 4 is a sectional view of a retention system secured to an incubator door in a partially-open position in accordance with an embodiment.
Figure 5:
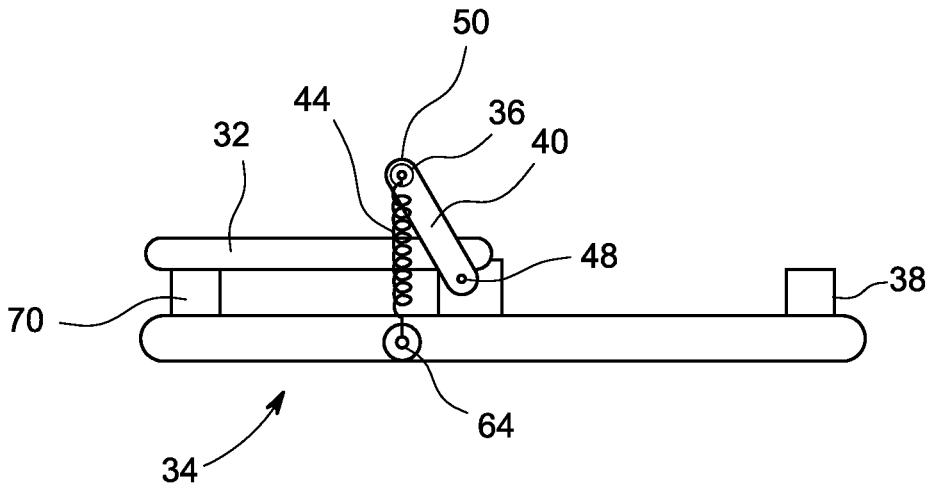
FIG. 5 is a sectional view of a retention system secured to an incubator door in a fully-closed position in accordance with an embodiment.

Referring to FIGS. 3-5, a series of sectional figures sequentially illustrate the retention system 34 in accordance with an embodiment as the incubator door 32 is transitioned from fully-open to fully-closed, and then back to fully-open. The retention system 34 will hereinafter be described with reference to the orientations depicted in FIGS. 3-5. It should, however, be appreciated that the orientation may change for other applications.

Referring to FIG. 3, the retention system 34 is shown in accordance with an embodiment secured to an incubator door 32 in its fully-open position against door stop 38. When the incubator door 32 is in the fully-open position the retention system 34 is configured as subsequently described. The outer link 40 extends from the first pivot point 48 downward and toward the right such that its terminal end 50 is below terminal end 46. The inner link 42 extends generally upward from the second pivot point 52 and is nearly perpendicular to the outer link 40. The incubator door 32 is disposed above the outer link 40.

When the incubator door 32 is in the fully-open position shown in FIG. 3, the spring 44 applies a force pulling the terminal end 50 of outer link 40 downward in a clockwise direction toward the spring anchor point 64. This spring force is translated from the outer link 40 to the inner link 42 tending to pull it downward also, and then to the incubator door 32 pulling it against the door stop 38. In other words the spring 44 exerts a force, translated via the inner and outer links 40, 42, tending to hold the incubator door 32 fully open such that it's pulled into engagement with the incubator door stop 38.

According to one embodiment, the door stop 38 comprises a soft material such as a low durometer elastomer or nylon. In this manner contact between the incubator door 32 and the door stop 38 will be muted to minimize infant disturbance. It should also be appreciated that the retention system 34 does not disengage from the incubator door 32 in the traditional sense thereby further reducing any noise disturbance associated with a conventional closure's latch or pawl being struck during engagement.

Referring to FIG. 4, the retention system 34 is shown in accordance with an embodiment secured to an incubator door 32 in a partially-open position as its being transitioned toward fully-closed. A force F1, representing that which would normally be applied by a user physically pushing the incubator door 32 closed, overcomes the initial spring bias and pivots the incubator door 32 in a counter-clockwise direction about the third pivot point 58. Force F1 is translated via the incubator door 32 to the inner link 42, which pivots in a counter-clockwise direction about the second pivot point 52, and then to the outer link 40 which pivots in a counter-clockwise direction about the first pivot point 48.

After the Force F1 rotates the outer link 40 counter-clockwise passed the twelve o'clock position (best shown in FIG. 4), the spring 44 will assist the user and help draw the incubator door 32 toward fully-closed. Advantageously, a user need only partially close the incubator door 32 such that it's in close proximity to its fully-closed position, and thereafter the spring 44 automatically assists and draws the incubator door 32 fully-closed. For purposes of this disclosure, an incubator door 32 in close proximity to its fully-closed position should be defined to be positioned within 20 degrees of fully-closed. It should be appreciated that this automatic assist eliminates the potential for an unintentional incomplete door closure by drawing the incubator door 32 fully-closed even in the absence of a user applied force.

Referring to FIG. 5, the retention system 34 is shown in accordance with an embodiment secured to an incubator door 32 in its fully-closed position against door stop 70. When the incubator door 32 is in the fully-closed position, the outer link 40 extends upward and to the left from the first pivot point 48. The inner link 42 (shown in FIG. 3) is generally aligned and superimposed with the outer link 40. The incubator door 32 extends away from the inner link 42 toward the left and is disposed in engagement with door stop 70.

When the incubator door 32 is in the fully-closed position shown in FIG. 5, the spring 44 applies a force pulling the terminal end 50 of the outer link 40 downward in a counter-clockwise direction toward the spring anchor point 64. This spring force is translated from the outer link 40 to the inner link 42 tending to pull it downward also, and then to the incubator door 32 pulling it against the door stop 70. In other words the spring 44 exerts a force, translated via the inner and outer links 40, 42, tending to hold the incubator door 32 fully closed such that it's pulled into engagement with the incubator door stop 70. As previously described with respect to door stop 38, the door stop 70 may comprise a soft material to minimize any audible disturbance as the incubator door 32 engages the door stop 70.

It should be appreciated that the retention system 34 is designed to lock or retain the incubator door 32 closed. More precisely, the inner and outer links 40, 42 resist any force applied directly to the incubator door 32 that would otherwise tend to open the incubator door 32. Unlocking and opening the incubator door 32 requires a force applied near the terminal end 50 of the inner link 40 (e.g., via the handle 36) to rotate the inner link 40 clockwise past the twelve o'clock position and thereby unlock the retention system 34. Advantageously this feature reduces the likelihood that the incubator door 32 is inadvertently opened by securely locking the door 32 closed until a user chooses to open it such as, for example, by engaging the handle 36.

Figure 6:
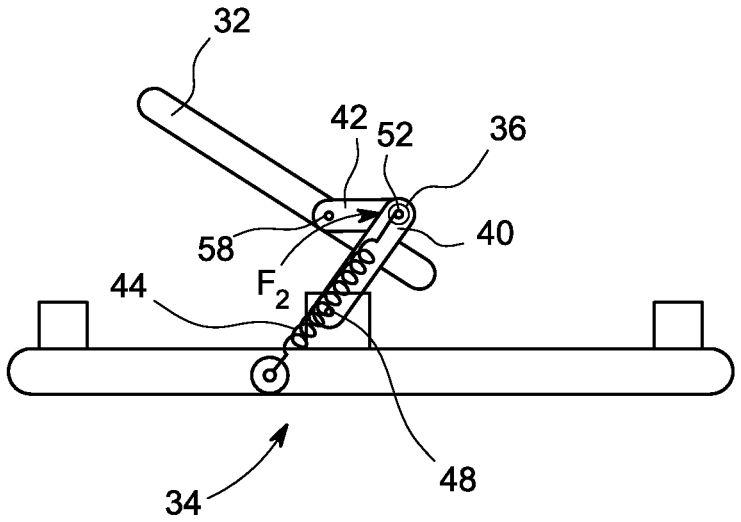
FIG. 6 is a sectional view of a retention system secured to an incubator door in a partially-open position in accordance with an embodiment.

Referring to FIG. 6, the retention system 34 is shown in accordance with an embodiment secured to an incubator door 32 in a partially-open position as its being transitioned toward fully-open. A force F2, representing that which would normally be applied by a user physically rotating the handle 36, overcomes the initial spring bias and pivots the incubator door 32 in a clockwise direction about the third pivot point 58. Force F2 is translated via the incubator door 32 to the inner link 42, which pivots in a clockwise direction about the second pivot point 52, and then to the outer link 40 which pivots in a clockwise direction about the first pivot point 48.

After the Force F2 rotates the outer link 40 clockwise passed the three o'clock position (best shown in FIG. 2), the spring 44 will assist the user and help draw the incubator door 32 toward fully-open. Advantageously, a user need only partially open the incubator door 32 such that it's in close proximity to its fully-open position, and thereafter the spring 44 automatically assists and draws the incubator door 32 fully-open. For purposes of this disclosure, an incubator door 32 in close proximity to its fully-open position should be defined to be positioned within 20 degrees of fully-open.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

I claim:

1. A door retention system for an infant care device comprising:

a plurality of links pivotably coupling a door with an infant care device, wherein the plurality of links includes a first link comprising a first terminal end and a second terminal end, the first terminal end pivotably secured to the infant care device, and wherein the plurality of links includes a second link comprising a first terminal end and a second terminal end, the second link pivotably secured at its first terminal end to the second terminal end of the first link and the second terminal end of the second link pivotably secured to the door, wherein the door is pivotable about the second terminal end of the second link; and an energy storage device, wherein the energy storage device is secured at the second terminal end of the first link;

wherein the energy storage device is configured to apply a force tending to open the door exclusively when the door is in close proximity to a fully-open position;

wherein the energy storage device is configured to apply a force tending to close the door exclusively when the door is in close proximity to a fully-closed position.

2. The door retention system of claim 1, wherein the infant care device is an infant incubator, and wherein the door is an incubator door.

3. The door retention system of claim 1, wherein the energy storage device is secured at a first end to the infant care device and at a second end to the second terminal end of the first link.

4. The door retention system of claim 3, wherein the energy storage device comprises a spring.

5. The door retention system of claim 3, wherein the energy storage device comprises an elastomeric band.

6. The door retention system of claim 1, further comprising a door stop.

7. The door retention system of claim 6, wherein the door stop is configured to engage the door with minimal noise.

8. The door retention system of claim 1, further comprising a handle secured to one of the plurality of links, wherein the handle is positioned for engagement by a user as the door is opened.

9. The door retention system of claim 8, wherein the plurality of links are configured to resist a force applied directly to the door that would otherwise tend to open the door, when the door is in the fully-closed position.

10. The door retention system of claim 8, wherein the plurality of links are configured to release the door from the fully-closed position when a force is applied directly to the handle.

11. An incubator door retention system comprising:

a first link pivotably secured to an incubator;

a second link pivotably secured between the first link at a first terminal end of the second link and an incubator door at a second terminal end of the second link, wherein the incubator door is pivotable about the second terminal end of the second link; and an energy storage device secured between the incubator and the first link;

wherein the energy storage device is configured to apply a force tending to open the incubator door exclusively when the incubator door is in close proximity to a fully-open position;

wherein the energy storage device is configured to apply a force tending to close the incubator door exclusively when the incubator door is in close proximity to a fully-closed position.

12. The incubator door retention system of claim 11, wherein the energy storage device comprises a spring.

13. The incubator door retention system of claim 11, wherein the energy storage device comprises an elastomeric band.

14. The incubator door retention system of claim 11, further comprising a door stop.

15. The incubator door retention system of claim 14, wherein the door stop is configured to engage the door with minimal noise.

16. The incubator door retention system of claim 11, further comprising a handle secured to one of the first link and the second link, wherein the handle is positioned for engagement by a user as the door is opened.

17. The incubator door retention system of claim 16, wherein the first and second links are configured to resist a force applied directly to the incubator door that would otherwise tend to open the incubator door, when the incubator door is in the fully-closed position.

18. The incubator door retention system of claim 16, wherein the first and second links are configured to release the incubator door from the fully-closed position when a force is applied directly to the handle.

* * * * *